US006084624A

United States Patent [19]

Yamakawa

[11] Patent Number: 6,084,624

[45] Date of Patent: Jul. 4, 2000

[54] COLOR THERMAL RECORDING METHOD AND COLOR THERMAL PRINTER

[75] Inventor: Kenji Yamakawa, Saitama, Japan

[73] Assignee: Fuji Photo Film Co., Ltd., Kanagawa, Japan

[21] Appl. No.: 08/892,227

[22] Filed: Jul. 14, 1997

[30] Foreign Application Priority Data

Jul. 15, 1996 [JP] Japan ..... 8-185113

[51] Int. Cl.[7] ..... B41J 2/325

[52] U.S. Cl. ..... 347/175; 347/212

[58] Field of Search ..... 347/172, 175, 347/212, 218, 238; 400/120.02, 120.03, 120.18, 120.04; 250/336.1; 324/403

[56] References Cited

U.S. PATENT DOCUMENTS

| | | | |
|---|---|---|---|
| 5,216,438 | 6/1993 | Nakao et al. | 347/172 |
| 5,268,707 | 12/1993 | Katsuma et al. | 347/212 |
| 5,463,417 | 10/1995 | Yamakawa | 347/212 |
| 5,629,729 | 5/1997 | Fujishiro | 347/175 |
| 5,743,663 | 4/1998 | Imai | 400/120.04 |
| 5,825,396 | 10/1998 | Fujishiro | 347/212 |

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

A color thermosensitive recording material includes a support and yellow, magenta and cyan thermosensitive coloring layers formed on the support. The three coloring layers are different in thermal sensitivity. The yellow coloring layer is the farthest from the support and having fixability to ultraviolet rays of a first wavelength range. The magenta coloring layer has fixability to ultraviolet rays of a second wavelength range. To print a full-color image, the recording material is conveyed alternately in advancing and returning directions. In conveying the recording material in the advancing direction for three times, yellow, magenta and cyan images are recorded respectively to the three coloring layers inside a recording area on the recording material by use of a thermal head. A fixer is operated, which selectively applies ultraviolet rays of the first and second wavelength ranges to the recording material being moved past a ray applying region in a printing path, to fix the magenta and cyan color images. While a border between the recording area and a non-recording area is moved past the ray applying region, a shutter is moved together with the recording material, to avoid fixing the magenta and yellow coloring layers in the non-recording area.

25 Claims, 12 Drawing Sheets

COLOR THERMAL RECORDING METHOD AND COLOR THERMAL PRINTER

BACKGROUND OF THE INVENTION

1. Field of the Invention

The present invention relates to a color thermal recording method and a color thermal printer. More particularly, the present invention relates to a color thermal recording method and a color thermal printer in which optical fixation of images can be regularly applied.

2. Description Related to the Prior Art

In a color thermal printer, a color thermosensitive recording material or sheet is used, to record a full-color image thereon according to the method of the frame-sequential printing. The recording material consists of a support and a cyan thermosensitive coloring layer, a magenta thermosensitive coloring layer and a yellow thermosensitive coloring layer, which are formed on the support in the order listed. Among those layers, the yellow coloring layer has the highest thermal sensitivity. The cyan coloring layer has the lowest thermal sensitivity. The yellow coloring layer has such a characteristic that its coloring ability is destroyed by application of near-ultraviolet rays of 420 nm. The yellow coloring layer is fixed before the magenta recording. The magenta coloring layer has such a characteristic that its coloring ability is destroyed by application of ultraviolet rays of 365 nm. The magenta coloring layer is fixed before the cyan recording.

Fixer lamps for emanating such ultraviolet rays have a cylindrical long shape, and are disposed crosswise to a direction of conveying the recording material. The recording material is kept flat while conveyed past a ray applying region defined under the fixer lamps. The ray applying region has a non-uniformity in the irradiance distribution of ultraviolet rays with respect to the conveying direction of the recording material, because of a difference between the cylindrical shape of the fixer lamps and the flatness of the recording material. To keep uniform a light amount of the ultraviolet rays between all points included in a recording area on the recording material, it is conceived that all the recording area is moved to a downstream end of the ray applying region of the fixer lamps. However it is inevitable that a small front portion of a non-recording area next to the recording area is moved into the ray applying region and subjected to ultraviolet rays. The small portion of the non-recording area is fixed before thermal recording being intended properly. If there is a partial image which should be recorded to the small portion, the partial image will not be recorded with a properly reproduced color. Accordingly a problem remains in that there occurs a portion of the recording material not usable effectively.

SUMMARY OF THE INVENTION

In view of the foregoing problems, an object of the present invention is to provide a color thermal recording method and a color thermal printer in which all portions of the recording material can be used effectively.

Another object of the present invention is to provide a color thermal recording method and a color thermal printer in which irradiance distribution of ultraviolet rays can be kept uniform inside the recording area of the recording material.

In order to achieve the above and other objects and advantages of this invention, a thermosensitive recording material is conveyed along a printing path alternately in first and second directions, the second direction being opposite to the first direction. In conveying the recording material along the printing path in the first direction for three times, first, second and third color images are recorded respectively to the first to third layers inside a recording area on the recording material by use of a thermal head. A fixer is operated, the fixer selectively applying electro-magnetic rays of the first and second wavelength ranges to the recording material being moved past a ray applying region in the printing path, to fix the second and third color images. While a border between the recording area and a non-recording area is moved past the ray applying region, a shutter is moved together with the recording material, to avoid fixing the second and third coloring layers in the non-recording area.

In a preferred embodiment, the recording material is unwound from a roll, and cut into a sheet after the full-color image is recorded.

The first direction is away from the roll with respect to the recording material, and the fixer is disposed in the first direction with respect to the thermal head.

Otherwise, the first direction is toward the roll with respect to the recording material, and the fixer is disposed in the second direction with respect to the thermal head.

Transport means for conveyance of the recording material is disposed in the first direction with respect to the thermal head, and includes a motor. A capstan roller is rotated by the motor. A pinch roller pushes the recording material to the capstan roller.

The ray applying region has first and second ends arranged along the printing path, and the shutter has a shutter edge previously positioned at the first end of the ray applying region. The shutter drive unit, while the shutter edge is positioned at the border, moves the shutter from the first end to the second end of the ray applying region, the ray applying region being changed from a fully open area to a fully closed area, or being changed from the fully closed area to the fully open area.

The shutter drive unit includes a clutch displaceable between connected and disconnected states. The clutch, when in the connected state, transmits rotation of the motor to the shutter to move the shutter, and when in the disconnected state, renders the shutter free from the motor.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
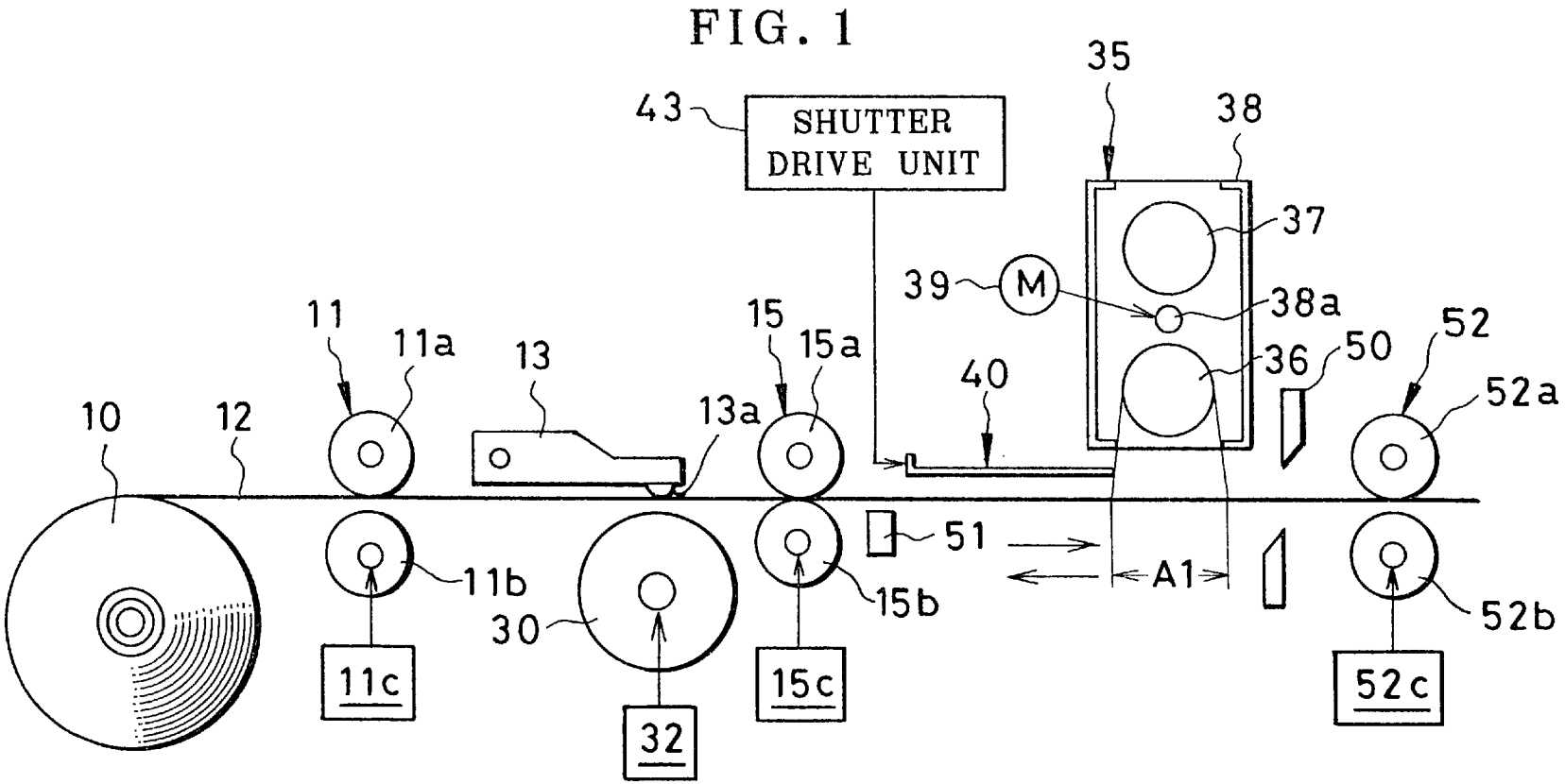
FIG. 1 is an explanatory view illustrating a color thermal printer.
Figure 1A:
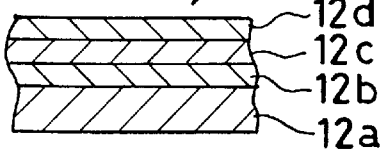
FIG. 1A is an explanatory view in section, illustrating a color thermosensitive recording material.

In FIG. 1, a recording material roll 10 consists of color thermosensitive recording material 12 in a form of continuous sheet which is wound in a roll shape. A supply roller set 11 draws the recording material 12 from the recording material roll 10 and supplies it to a thermal head 13. The supply roller set 11 consists of a combination of a capstan roller 11*a* as an upper roller and a nip roller 11*b* as a lower roller. A conveyor roller set 15 conveys the recording material 12. The supply roller set 11 is synchronized with the conveyor roller set 15 to supply the recording material 12. A roller shifter mechanism 11*c* shifts the supply roller set 11 to a nipping state while a front edge of the recording material 12 moves past the supply roller set 11 toward the conveyor roller set 15. After the front edge comes in an advancing direction, the shifter mechanism 11*c* keeps the supply roller set 11 in a free state in which the nip roller 11*b* is away from the capstan roller 11*a* without the nipping, before the end of a printing sequence of one frame The recording material 12 consists of a support 12*a* and a cyan thermosensitive coloring layer 12*b*, a magenta thermosensitive coloring layer 12*c* and yellow thermosensitive coloring layer 12*d*, which are formed on the support 12*a* in the order listed. Among those layers, the yellow coloring layer 12*d* has the highest thermal sensitivity. The yellow coloring layer 12*d* has such a characteristic that its coloring ability is destroyed by application of near-ultraviolet rays of 420 nm. The magenta coloring layer 12*c* has such a characteristic that its coloring ability is destroyed by application of ultraviolet rays of 365 nm.

The conveyor roller set 15 consists of a capstan roller 15*a* and a nip roller 15*b*. A roller shifter mechanism 15*c* shifts the conveyor roller set 15 between a nipping state in which the nip roller 15*b* contacts the capstan roller 15*a* for nipping of the recording material 12, and a free state in which the nip roller 15*b* is away from the capstan roller 15*a* without the nipping. The shifter mechanism 15*c* consists of a solenoid. Alternatively the shifter mechanism 15*c* may comprise a cam rotated by a motor to shift the nip roller 15*b*. Before the front edge of the recording material 12 is moved from the supply roller set 11 to the conveyor roller set 15, the shifter mechanism 15*c* shifts the conveyor roller set 15 to the free state. After the supply of the recording material 12, the shifter mechanism 15*c* keeps the conveyor roller set 15 in the nipping state before the end of the printing sequence of one frame.

A platen roller 30 and the thermal head 13 are disposed between the recording material roll 10 and the conveyor roller set 15. The thermal head 13 is disposed in a stationary manner. The platen roller 30 is formed of hard rubber, rotatable, and is also movable vertically by means of a lifter mechanism 32 for upward and downward motion. For the thermal recording, the lifter mechanism 32 is moved up to press the recording material 12 against a heating element array 13a of the thermal head 13. Note that it is possible to dispose the platen roller 30 in a stationary manner and the thermal head 13 in a vertically movable manner. The heating element array 13*a* of the thermal head 13 consists of a line of a great number of heating elements arranged in the axial direction of the platen roller 30. During the thermal recording, each heating element is driven to record a full-color image according to the frame-sequential printing.

A fixer assembly 35 is disposed in a position further from the conveyor roller set 15 in the advancing direction. The fixer assembly 35 includes a yellow fixer lamp 36, a magenta fixer lamp 37 and a lamp housing 38. The yellow fixer lamp 36 emanates visible near-ultraviolet rays peaking at a wavelength of 420 nm. The magenta fixer lamp 37 emanates ultraviolet rays peaking at a wavelength of 365 nm. The lamp housing 38 is caused by a motor 39 to make half a rotation about a shaft 38*a*, so that a selected one of the yellow and magenta fixer lamps 36 and 37 is set in a fixing position confronted with the recording material 12.

Figure 2:
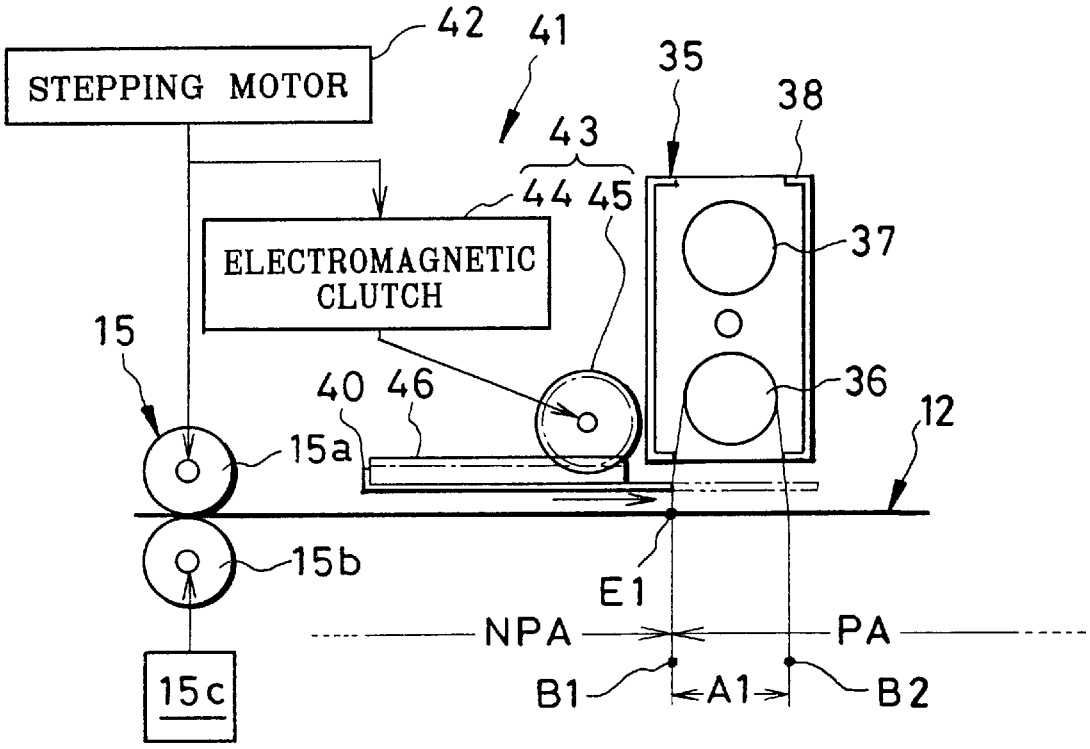
FIG. 2 is an explanatory view illustrating a fixer assembly of the color thermal printer.

Between the fixer assembly 35 and the recording material 12 is disposed a shutter 40, which is movable in parallel with the recording material 12, to block fixing rays from the yellow and magenta fixer lamps 36 and 37. The shutter 40 consists of an opaque plate slidable in a conveying direction of the recording material 12. In FIG. 2, the shutter 40 is shifted by a shutter control unit 41 between an open position indicated by the solid line where a ray applying region A1 is fully open, and a closed position indicated by the phantom line where the ray applying region A1 is fully closed. In the open position, a shutter edge of the shutter 40 is located at a first end B1 of the ray applying region A1.

The shutter control unit 41 includes a stepping motor 42 and a shutter drive unit 43. The stepping motor 42 rotates the capstan roller 15*a* of the conveyor roller set 15. The shutter drive unit 43, when in a connected state, converts rotation of the stepping motor 42 into a sliding motion for the shutter 40. The shutter drive unit 43 includes a pinion 45 and a rack 46. The rotation of the stepping motor 42 is transmitted to the pinion 45 by an electromagnetic clutch 44 as shutter drive unit. The rack 46 is engaged with the pinion 45. When a border E1 defined between a recording area PA and a non-recording area NPA on the recording material 12 is moved past the first end B1 of the ray applying region A1, the shutter edge of the shutter 40 is controlled by the electromagnetic clutch 44 to follow a position of the border E1 when the border E1 reaches the shutter edge. The electro-magnetic clutch 44 is operated at such suitable time that the shutter 40 starts moving with the border E1 by transmission of rotation of the stepping motor 42 to the pinion 45 of the shutter drive unit 43. The electromagnetic clutch 44 causes the shutter 40 to move at the speed equal to that at which the recording material 12 is conveyed.

Note that the border E1 is a virtual invisible line used for the purpose of describing the opening and closing of the shutter 40. When the non-recording area NPA passes through the ray applying region A1, the non-recording area NPA is covered by the shutter 40. In the present embodiment, the shutter edge of the shutter 40, when set in its home position, is positioned at the first end B1 of the ray applying region A1. Instead the shutter 40 may have a home position defined away from the first end B1 and out side the ray applying region A1. In such a case, the border E1 on the recording material 12 monitored to detect a time point when the border E1 passes a position of the shutter edge of the shutter 40. Upon the detection, the shutter 40 is driven to move, so that the border E1 is kept positioned at the shutter edge of the shutter 40.

In FIG. 1, a cutter 50 is disposed in a position further from the fixer assembly 35 in the advancing direction. The cutter 50 includes an upper blade being movable and a lower blade being stationary. After the full-color recording, the cutter 50 is actuated to cut the recorded portion into a sheet or a print. There is an edge sensor 51 disposed near to the conveyor roller set 15 for detecting a front edge of the recording material 12.

Figure 2A:
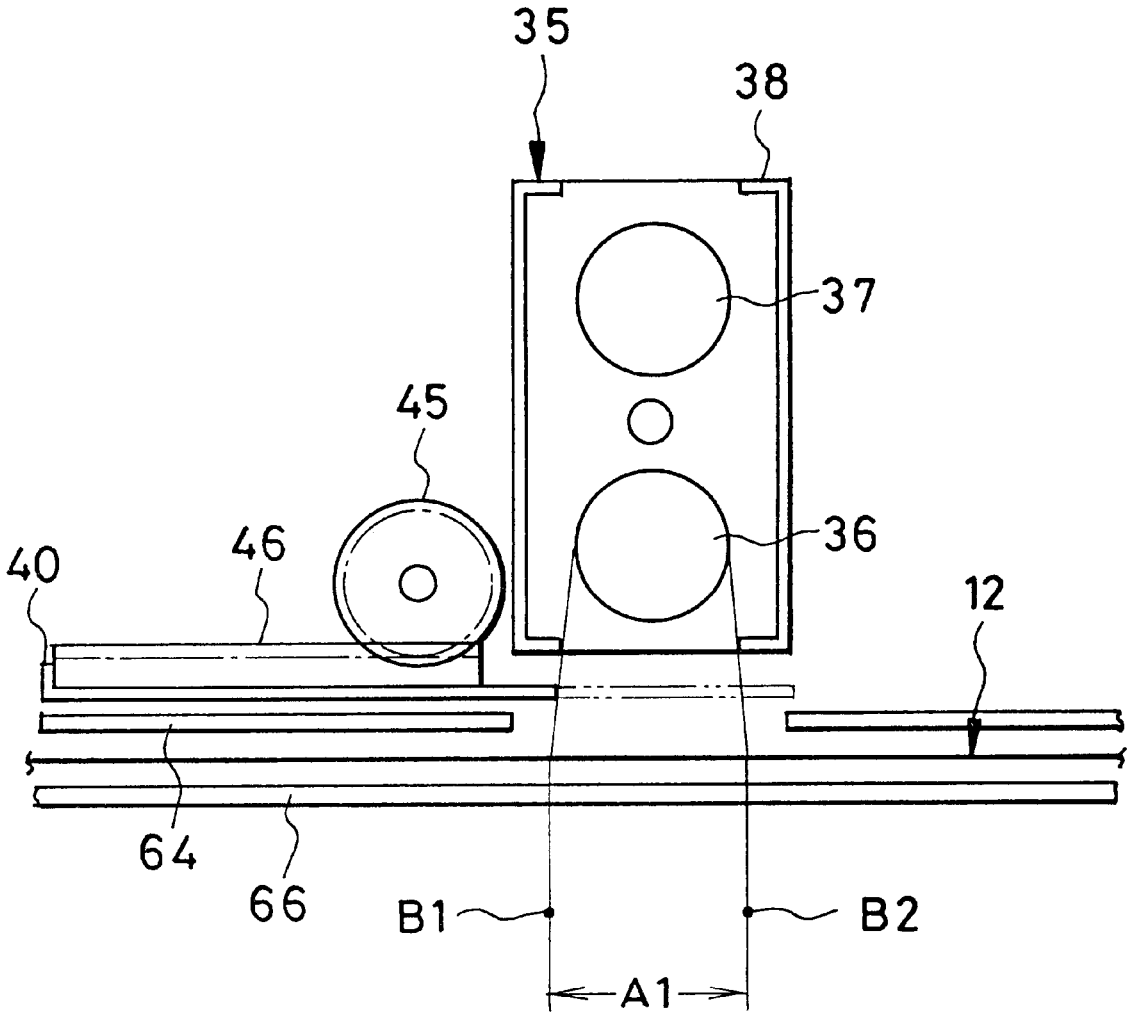
FIG. 2A is an explanatory view illustrating the fixer assembly with guide plates for the recording material.

An exit roller set 52 is disposed in a position further from the cutter 50 in the advancing direction. The exit roller set 52 nips the sheet as print and exits it through an outlet slot. In FIG. 2A, upper and lower guide plates 64 and 66 are disposed between the conveyor roller set 15 and the outlet slot, and define a printing path for the recording material 12 between them. Of course the guide plates 64 and 66 have cutouts in positions of the cutter 50 and the platen roller 30. There is a ray applying opening formed in the upper guide plate 64 under the fixer assembly 35.

Figure 3:
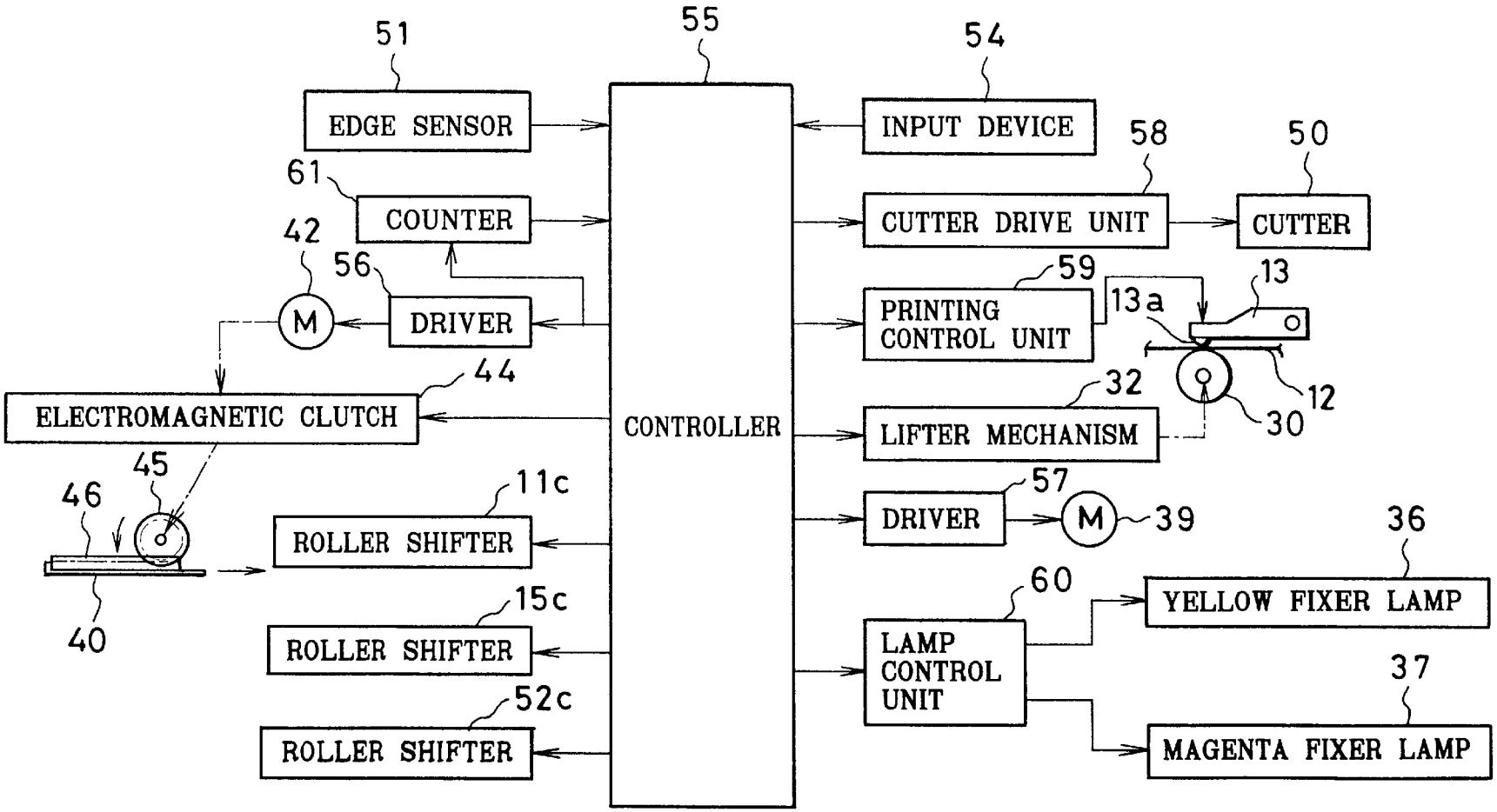
FIG. 3 is a schematic diagram illustrating circuitry of the color thermal printer.

In FIG. 3, circuitry of the color thermal printer is schematically illustrated. An input device 54 includes a print starting key, and sends commands to a controller 55. The controller 55 controls various units, including: the electromagnetic clutch 44, drivers 56 and 57, a cutter drive unit 58, the lifter mechanism 32, a printing control unit 59, a lamp control unit 60, the shifter mechanism 11*c* and 15*c*, a roller shifter mechanism 52*c*, and a counter 61.

The controller 55 sends a rotational direction signal and drive pulses to the driver 56. The driver 56 rotates the stepping motor 42 forwards or in reverse, to rotate the capstan roller 11*a* of the supply roller set 11, the capstan roller 15*a* of the conveyor roller set 15, and a capstan roller 52*a* of the exit roller set 52 forwards or in reverse. The counter 61 starts counting pulses upon receipt of an edge detecting signal from the edge sensor 51. When the stepping motor 42 rotates forwards, the counter 61 counts incrementally. When the stepping motor 42 rotates in reverse, the counter 61 counts decrementally. The driver 57 controls rotation of a motor 39 to rotate the lamp housing 38.

The cutter drive unit 58 moves up and down the movable blade of the cutter 50, which is caused to cut the recording material 12 along a virtual cutting line to obtain one sheet as a print. The lifter mechanism 32 consists of a motor and a cam, and when in an upper position, raises the platen roller 30 to press the recording material 12 against the heating element array 13*a* of the thermal head 13. The lifter mechanism 32, when in a lower position, lowers the platen roller 30 to let the recording material 12 away from the heating element array 13*a*. The printing control unit 59 consists of a combination of a head driver and a memory, which stores three-color image data of one frame. The printing control unit 59 drives each heating element of the thermal head 13 according to the image data of each color. The heating elements apply heat according to the image data and designated colors, so that the recording material 12 is colored at desired density.

The lamp control unit 60 controls ray emission of the yellow and magenta fixer lamps 36 and 37. Each of the shifter mechanisms 11*c*, 15*c* and 52*c* consists of a solenoid, and shifts the nip roller 11*b* of the supply roller set 11, the nip roller 15*b* of the conveyor roller set 15, or a nip roller 52*b* of the exit roller set 52.

Figure 4:
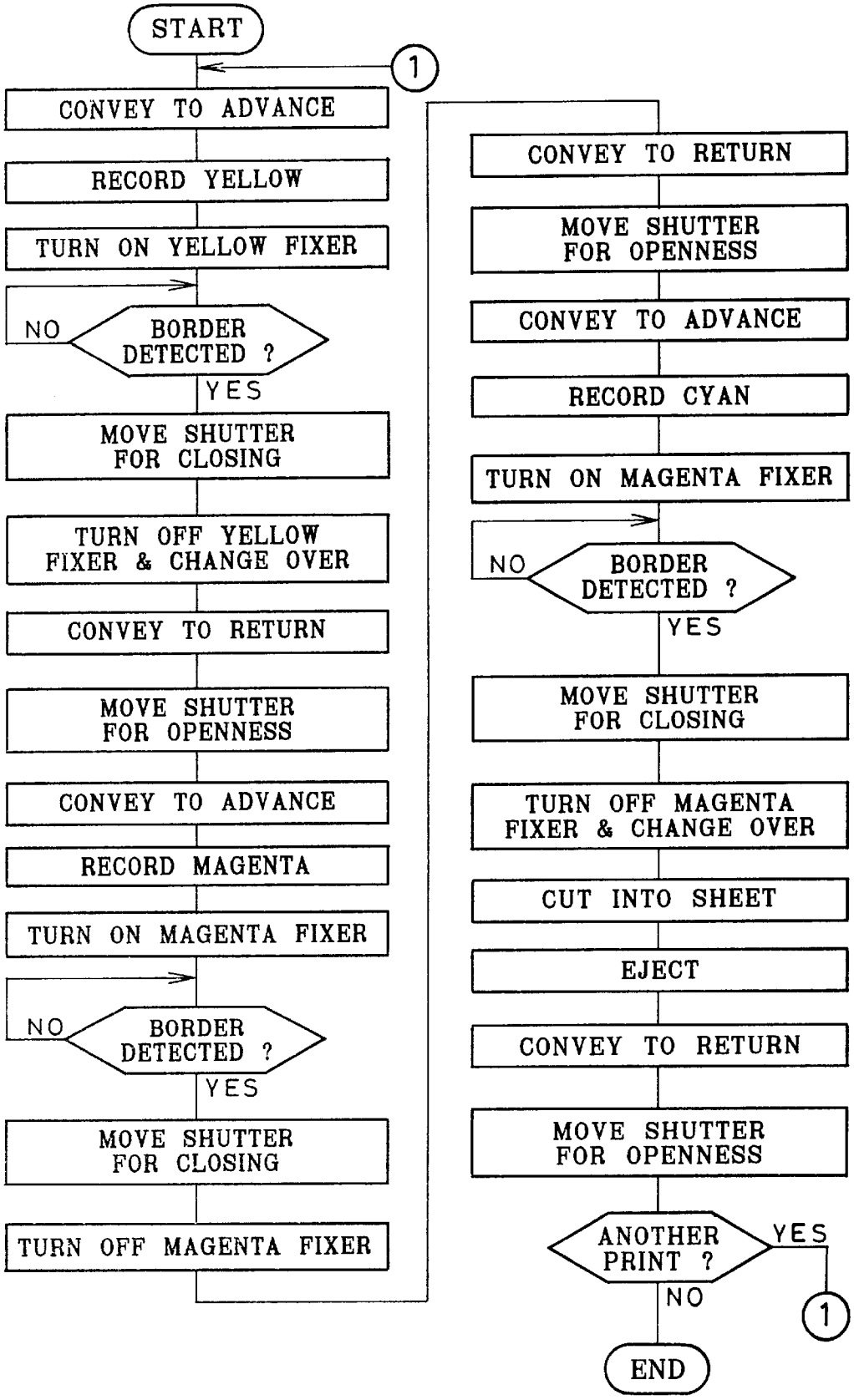
FIG. 4 is a flow chart illustrating a printing process of the color thermal printer.

The operation of the above embodiment is described by referring to the flow chart of FIG. 4. At first the recording material roll 10 being new is set in a set position illustrated in FIG. 1. Image data to be used for printing is fetched. Then the input device 54 is operated to enter a printing command. The controller 55 responsively causes the driver 56 to rotate the stepping motor 42. The stepping motor 42 rotates the conveyor roller set 15 and the supply roller set 11, which pulls the recording material 12 from the recording material roll 10, and sends it to the conveyor roller set 15 in the free state without nipping. Upon reach of the recording material 12 at the edge sensor 51, the edge sensor 51 sends a detecting signal to the controller 55.

When the controller 55 receives the edge detecting signal, the controller 55 causes the shifter mechanism 15*c* to shift the nip roller 15*b*. The conveyor roller set 15 comes to have the nipping state. The capstan roller 15*a* is rotated by the stepping motor 42. When the conveyor roller set 15 has the nipping state, the capstan roller 15*a* conveys the recording material 12. When the recording material 12 is conveyed by the conveyor roller set 15, the supply roller set 11 comes to have the free state without nipping. Upon detection of the front edge, the counting operation of the counter 61 is started. The counter 61 counts the drive pulses supplied to the stepping motor 42, to monitor an amount of advancing the recording material 12.

When the count of the counter 61 comes up to a predetermined value during conveyance of the recording material 12, it is detected that a front edge of the recording area PA has reached the heating element array 13*a* of the thermal head 13. Then a yellow image starts being recorded to the recording area PA. Before the front edge of the recording area PA reaches the ray applying region A1 of the fixer assembly 35, the yellow fixer lamp 36 is turned on. The recording area PA passes through the ray applying region A1, and so that the yellow image is fixed.

When the border E1 between the recording area PA and the non-recording area NPA reaches the first end B1 of the ray applying region Al, the reach of the border E1 is detected according to the count of the counter 61. The electromagnetic clutch 44 is turned on to convert rotation of the stepping motor 42 into the sliding motion of the shutter 40 by means of the pinion 45 and the rack 46. When the shutter edge of the shutter 40 comes to the border E1, then the shutter 40 starts moving together with the recording material 12. Thus the non-recording area NPA next to the recording area PA is covered by the shutter 40, and prevented from being fixed. A rear end of the recording area PA is passed through the ray applying region A1, and can receive application of fixing rays with a uniform distribution.

When the shutter 40 closes the ray applying region A1, the closing of the shutter 40 is detected according to the count of the counter 61. Rotation of the stepping motor 42 is stopped, so that movement of the recording material 12 and the shutter 40 is stopped and finished. Then the controller 55 turns off the yellow fixer lamp 36. The driver 57 is caused to drive the motor 39. The lamp housing 38 makes half a rotation to set the magenta fixer lamp 37 toward the recording material 12.

After finishing advancing the recording material 12, the controller 55 causes the stepping motor 42 to rotate in reverse, to return the recording material 12 along the printing path. With the recording material 12 returned, a portion of the recording material 12 becomes loose between the supply roller set 11 and the recording material roll 10. This portion is contained about the recording material roll 10 in a loose manner. Note that it is possible that the recording material roll 10 is rotated in reverse to wind the portion that would be loose. Also it is possible that a free loop is formed between the recording material roll 10 and the supply roller set 11 to reserve the recording material 12 in a provisional manner.

In the return of the recording material 12, the electromagnetic clutch 44 is turned on for a predetermined period, to move back the shutter 40 from the closed position to the open position. A returning distance of the recording material 12 is measured by a countdown operation of the counter 61. Upon detecting the front edge of the recording material 12 at the edge sensor 51 during the return of the recording material 12, then reverse rotation of the stepping motor 42 is stopped. The count of the counter 61 is reset. Then the stepping motor 42 is rotated forwards. Pulses of driving the stepping motor 42 are counted by the counter 61 in an ordinary upward manner. When it is detected according to the count that the front edge of the recording area PA has reached the heating element array 13*a*, then a magenta image starts being recorded to the recording area PA. Before the front edge of the recording area PA reaches the ray applying region A1, the magenta fixer lamp 37 is turned on. When the border E1 between the recording area PA and the non-recording area NPA reaches the first end B1 of the ray applying region Al, then the electromagnetic clutch 44 is turned on. The non-recording area NPA next to the border E1 is covered by the shutter 40 and protected from ultraviolet rays. When the border E1 is moved past the ray applying region A1, the stepping motor 42 is stopped. The recording material 12 and the shutter 40 are stopped.

After the return, the recording material 12 is advanced again. A cyan image is recorded to the recording material 12. During the cyan recording, the magenta fixer lamp 37 is driven to bleach all blank portions including portions inside the recording area PA and a marginal portion about the recording area PA. In the bleaching operation, the shutter 40 is moved and covers the non-recording area NPA while the border E1 on the recording material 12 passes the ray applying region A1. After bleaching, the magenta fixer lamp 37 is turned off. The motor 39 causes the lamp housing 38 to make half a rotation to stand by for yellow fixation of another print. When a cutting line, defined virtually for cutting of the recording material 12, reaches the cutter 50, the recording material 12 is stopped. The cutter 50 is actuated to cut the recording material 12 along the cutting line, to obtain a sheet as a print.

During the thermal recording of each color image, the platen roller 30 is shifted upwards by the lifter mechanism 32, to press the recording material 12 against the heating element array 13*a* of the thermal head 13. The thermal head 13 is driven by the cutter drive unit 58 according to the image data of each color, to record images line after line. After the thermal recording, the platen roller 30 is shifted downwards by the lifter mechanism 32, to release the recording material 12 from pressure toward the thermal head 13.

The print being separated is exited by the exit roller set 52. After cutting the recording material 12, the nip roller 52*b* of the exit roller set 52 is shifted by the shifter mechanism 52*c* to displace the exit roller set 52 into the nipping state. Only the exit roller set 52 is rotated to send out the print to a tray through the outlet slot. Then the recording material 12 is returned and set in a start position. During the return, the electromagnetic clutch 44 is turned on for a predetermined period, to move back the shutter 40 from the open position to the closed position.

Of course a printing operation for another print is similar to the above. The recording material 12 is advanced for three times to print a full-color image. A sheet is cut finally and is ejected.

Figure 5:
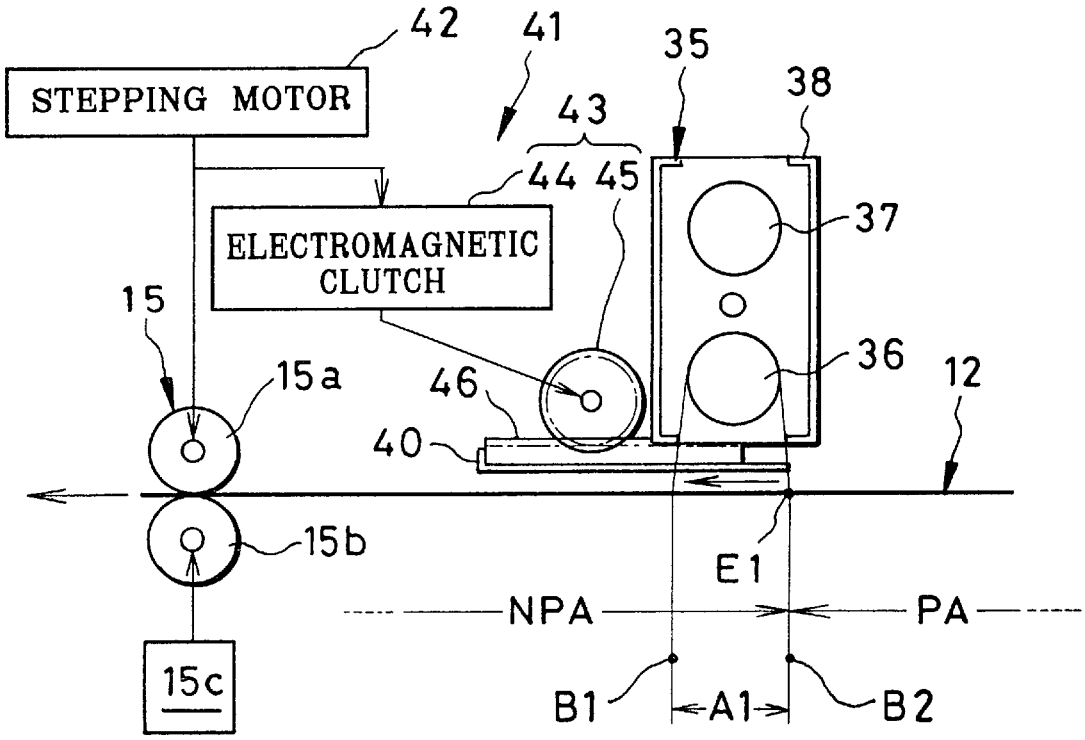
FIG. 5 is an explanatory view illustrating another preferred embodiment in which the fixer assembly of the color thermal printer effects fixation in a returning conveyance.
Figure 6:
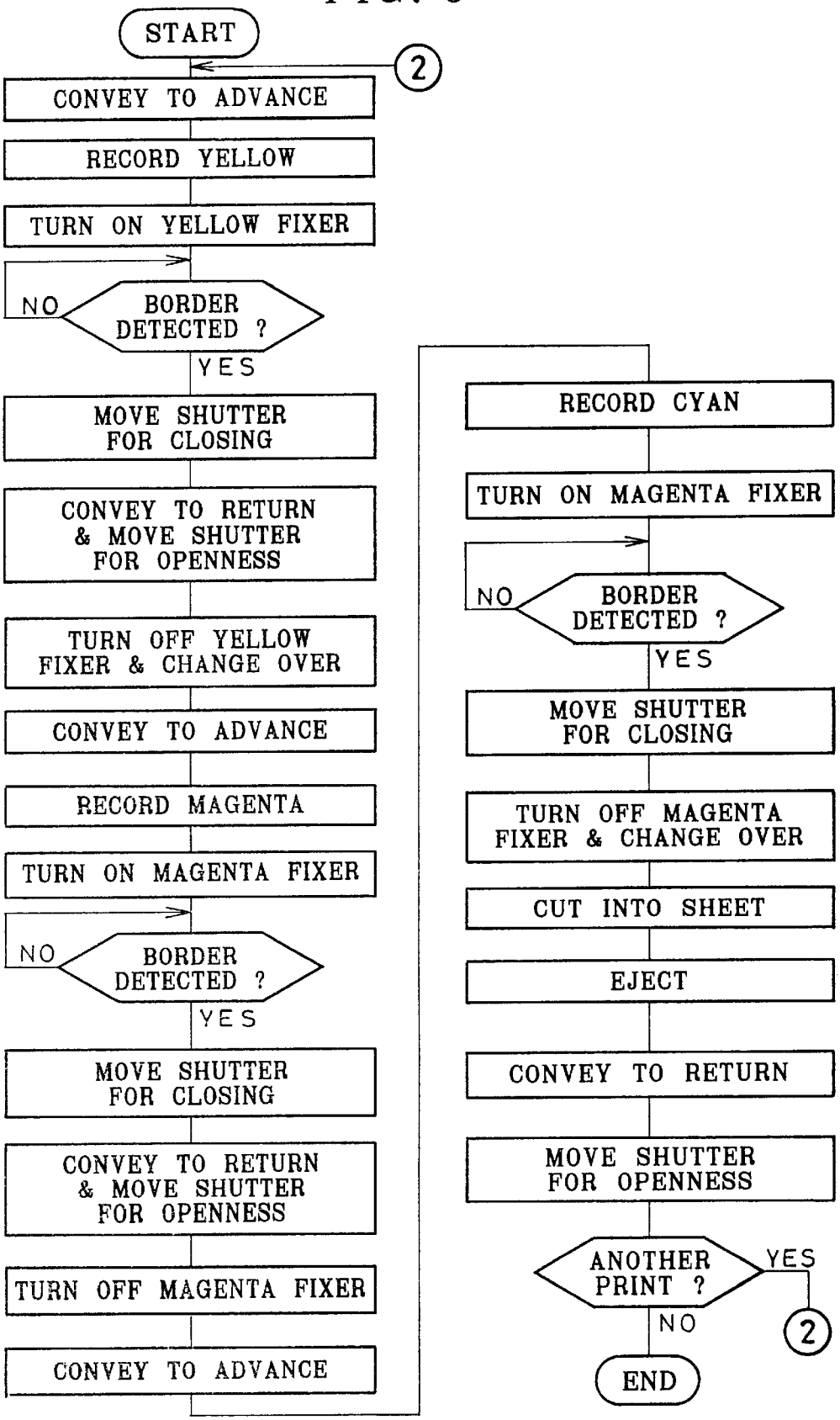
FIG. 6 is a flow chart illustrating another preferred printing process in which the recording material is fixed in both advancing and returning conveyances with the mechanism of FIG. 5.

In FIGS. 1–4, the recording material 12 is fixed only in the advancing conveyance. Alternatively the recording material 12 may be fixed both in the advancing and returning directions, as depicted in FIG. 6. In FIG. 5, the yellow fixer lamp 36 is turned on for yellow fixation. When the border E1 of the non-recording area NPA on the recording material 12 is conveyed back from the second end B2 of the ray applying region A1 toward the first end B1, the shutter edge of the shutter 40 is controlled to follow a position of the border E1. The shutter 40 is moved with the border E1 by transmission of rotation of the stepping motor 42 to the pinion 45 of the shutter drive unit 43. The shutter 40 is caused to move back at the speed equal to that at which the recording material 12 is returned. While the rear edge of the recording area PA of the recording material 12 passes the ray applying region A1, the non-recording area NPA is covered by the shutter 40. Thus the rear edge of the recording area PA is adequately fixed.

Figure 7:
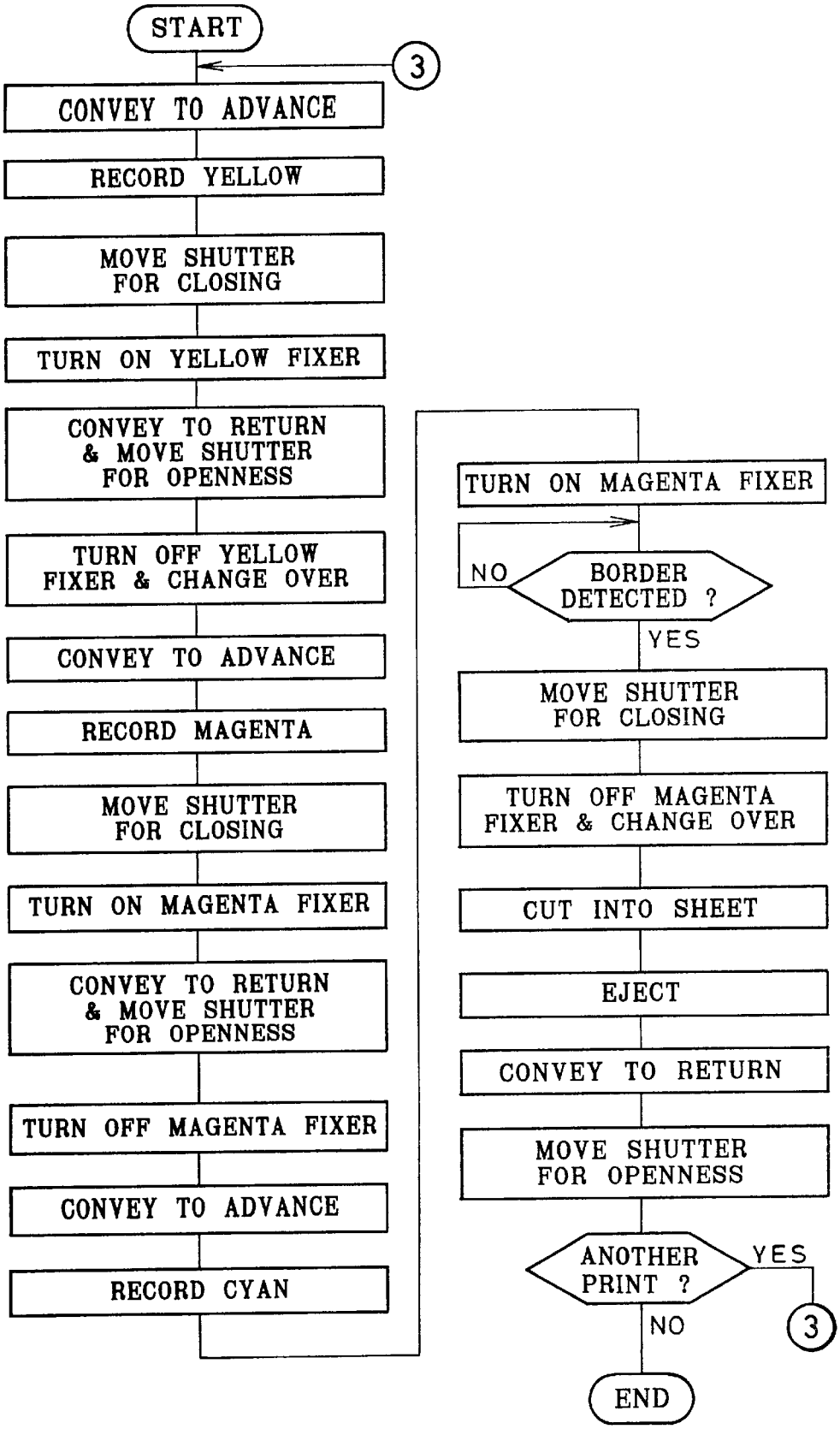
FIG. 7 is a flow chart illustrating a further preferred printing process in which the recording material is fixed only in the returning conveyance with the mechanism of FIG. 5.

In FIG. 6, the recording material 12 is fixed both in the advancing and returning directions. Alternatively the recording material 12 may be fixed only in the returning conveyance as illustrated in FIG. 7. In this embodiment, a first advancement of the recording material 12 is used for recording the yellow image. A first return of the recording material 12 is used for fixing the yellow image. A second advancement of the recording material 12 is used for recording the magenta image. A second return of the recording material 12 is used for fixing the magenta image. A third advancement of the recording material 12 is used both for recording the cyan image and for bleaching of the recording material 12. Also it is possible that a third advancement of the recording material 12 is used only for recording the cyan image, and that a third return of the recording material 12 is used for bleaching of the recording material 12. Of course the shutter 40 shields the non-recording area NPA from ultraviolet rays while the non-recording area NPA passes the ray applying region A1 as illustrated in FIG. 5.

Figure 8:
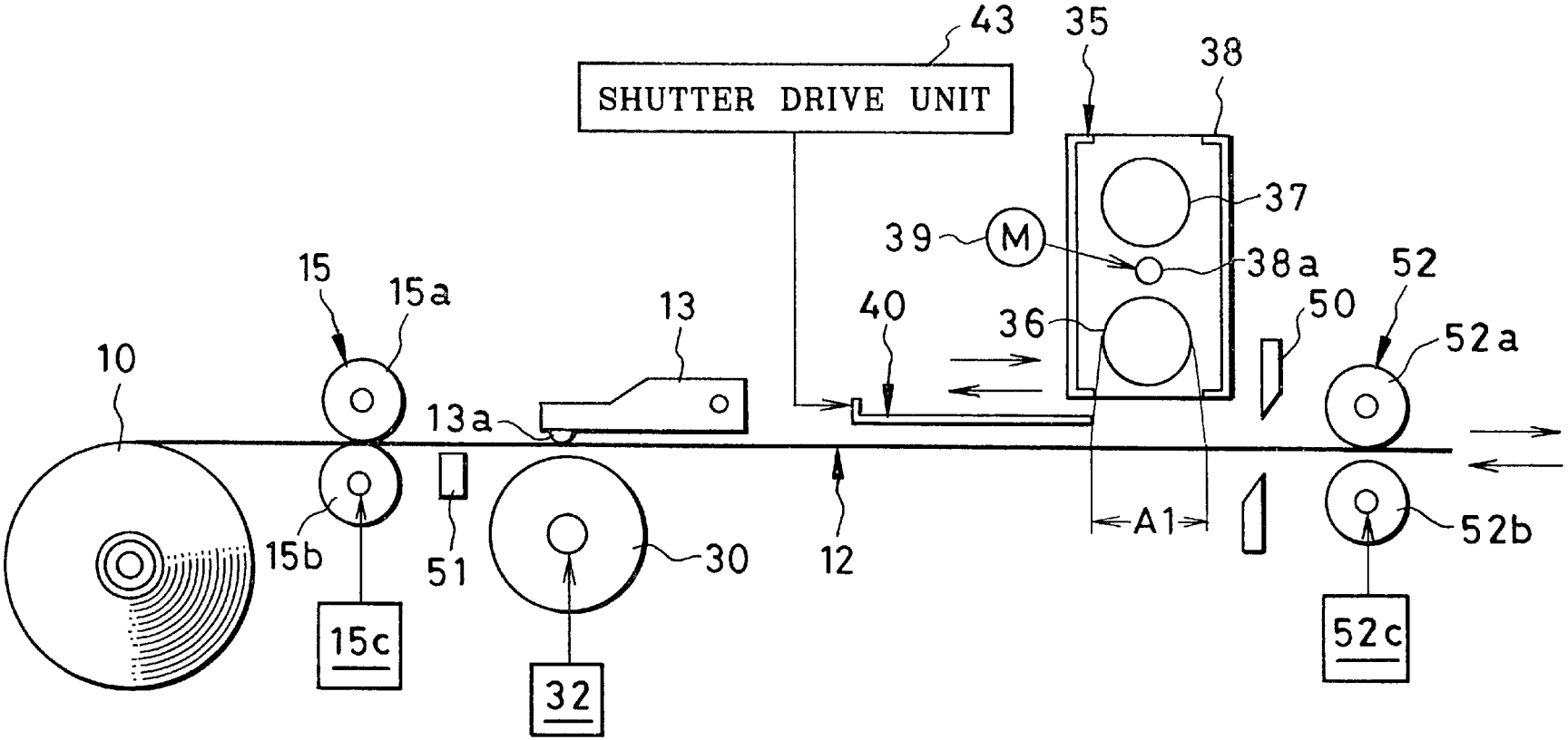
FIG. 8 is an explanatory view illustrating another preferred thermal printer in which the recording material is heated for recording in the returning conveyance.
Figure 9:
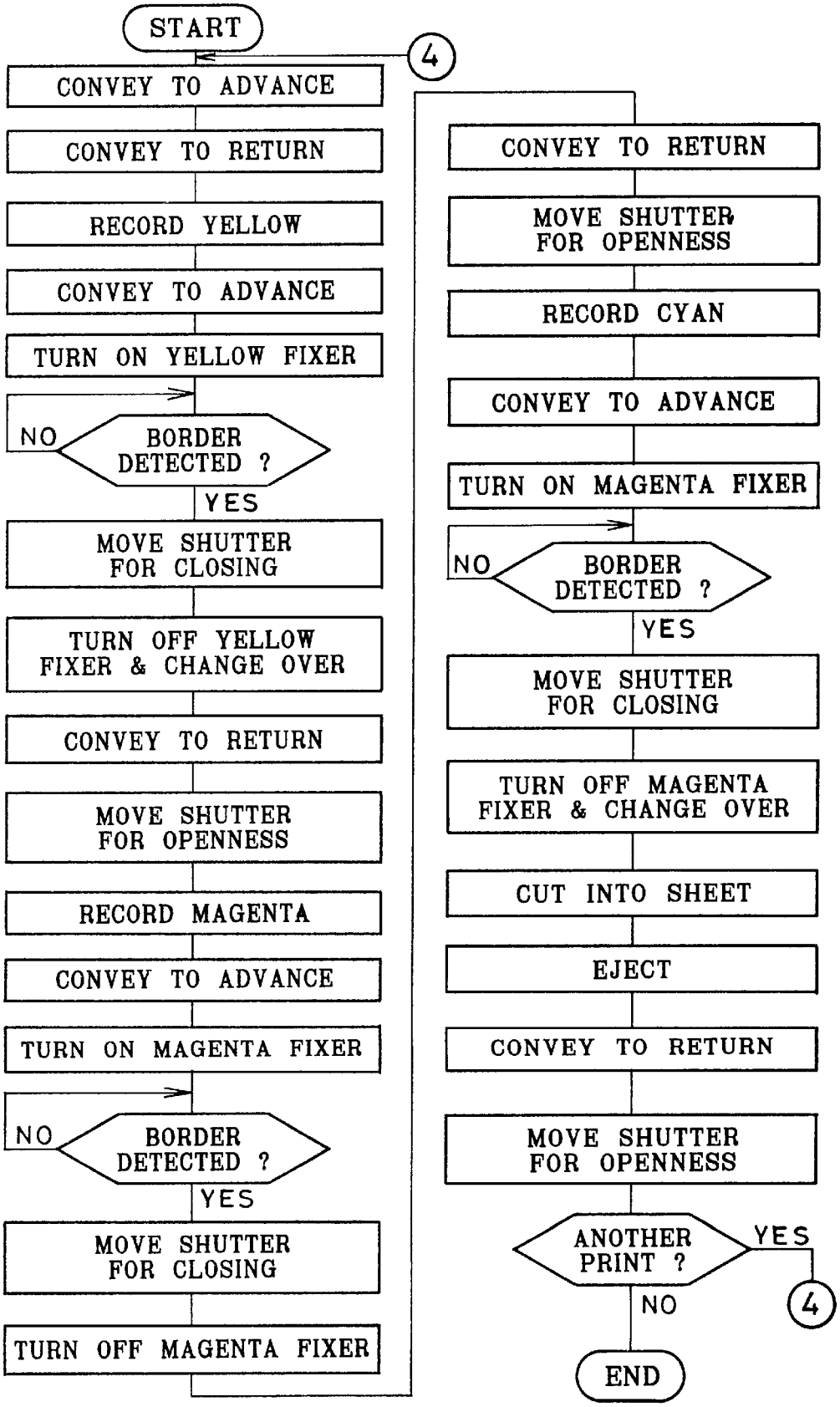
FIG. 9 is a flow chart illustrating an additional preferred printing process in which the recording material is heated for recording in the returning conveyance, and then fixed in the advancing conveyance, in the printer of FIG. 8.

In the above embodiments, the recording material 12 is subjected to thermal recording in the advancing conveyance. Alternatively the recording material 12 may be advanced simply without treatment, may be subjected to recording in the returning conveyance, and may be fixed in the advancing conveyance, as illustrated in FIGS. 8 and 9. This is a construction basically disclosed in a commonly assigned patent application U.S. Ser. No. 08/690,317 (corresponding to JP-A 9-99572). Elements similar to those of the above embodiments are designated with identical reference numerals. In a manner similar to FIG. 2, when the border E1 of the non-recording area NPA is conveyed between the ends B1 and B2 of the ray applying region A1, the shutter edge of the shutter 40 is controlled to follow the border E1. The shutter 40 is moved together with the border E1 by the above mechanical construction. The shutter 40 is caused to move back or forth at the speed equal to that at which the recording material 12 is returned or advanced. During passage in the ray applying region Al, the non-recording area NPA is covered by the shutter 40.

In FIG. 9, the recording material 12 is advanced by a predetermined distance, and then returned. A yellow image is recorded during the first return. After the yellow recording, the recording material 12 is advanced by the predetermined distance. The yellow image is fixed during the second advancement. Similarly, a magenta image is recorded during the second return. After the magenta recording, the recording material 12 is advanced by the predetermined distance. The magenta image is fixed during the third advancement. A cyan image is recorded during the third return. After the cyan recording, the recording material 12 is advanced, and bleached during the third advancement. The shutter 40 in FIG. 2 shields the non-recording area NPA from ultraviolet rays while the non-recording area NPA passes the ray applying region A1. After the yellow fixation in the course of the second advancement, the controller 55 turns off the yellow fixer lamp 36. The lamp housing 38 is caused to make half a rotation to set the magenta fixer lamp 37 toward the recording material 12.

Then the recording material 12 is returned for the second return, during which a magenta image is recorded. After finishing the magenta recording, the recording material 12 is advanced for the third advancement, during which the magenta image is fixed. Again the shutter 40 shields the non-recording area NPA from ultraviolet rays for the magenta fixation.

Similarly the third return is effected to record the cyan image. After the cyan recording, a fourth advancement of the recording material 12 is effected. The magenta fixer lamp 37 applies rays to the recording area PA to bleach all blank portions including portions inside the recording area PA and a marginal portion about the recording area PA. In the bleaching operation, the shutter 40 is moved and covers the non-recording area NPA while the border E1 on the recording material 12 passes the ray applying region A1. After the shutter 40 is closed, the magenta fixer lamp 37 is turned off, before the yellow fixer lamp 36 is rotated and directed to the recording material 12. When the cutting line reaches the cutter 50, the stepping motor 42 is stopped. The cutter drive unit 58 drives the cutter 50 to cut the recording material 12 along the cutting line, to obtain a sheet as a print. Those steps are depicted in FIG. 9.

Figure 10:
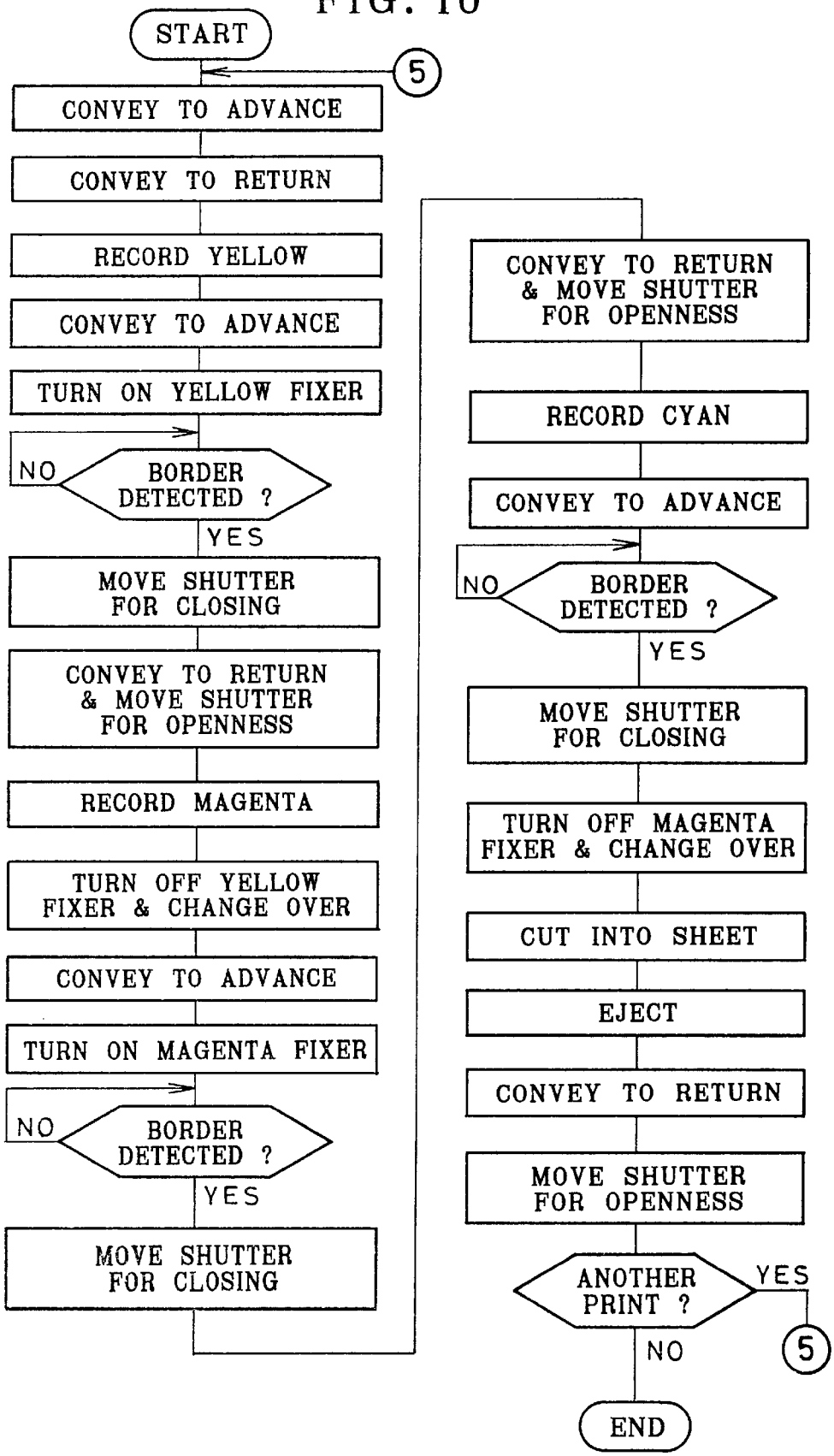
FIG. 10 is a flow chart illustrating still another preferred printing process in which the recording material is fixed in both advancing and returning conveyances.

In FIGS. 8 and 9, the recording material 12 is fixed only in the advancing conveyance. Alternatively the recording material 12 may be fixed both in the advancing and returning directions, as depicted in FIG. 10. In FIG. 5, the yellow fixer lamp 36 is turned on for yellow fixation. When the border E1 of the non-recording area NPA is conveyed back from the second end B2 toward the first end B1, the shutter edge of the shutter 40 is controlled to follow the border E1. The shutter 40 is moved with the border E1. The shutter 40 is caused to move back at the speed equal to that at which the recording material 12 is returned.

Figure 11:
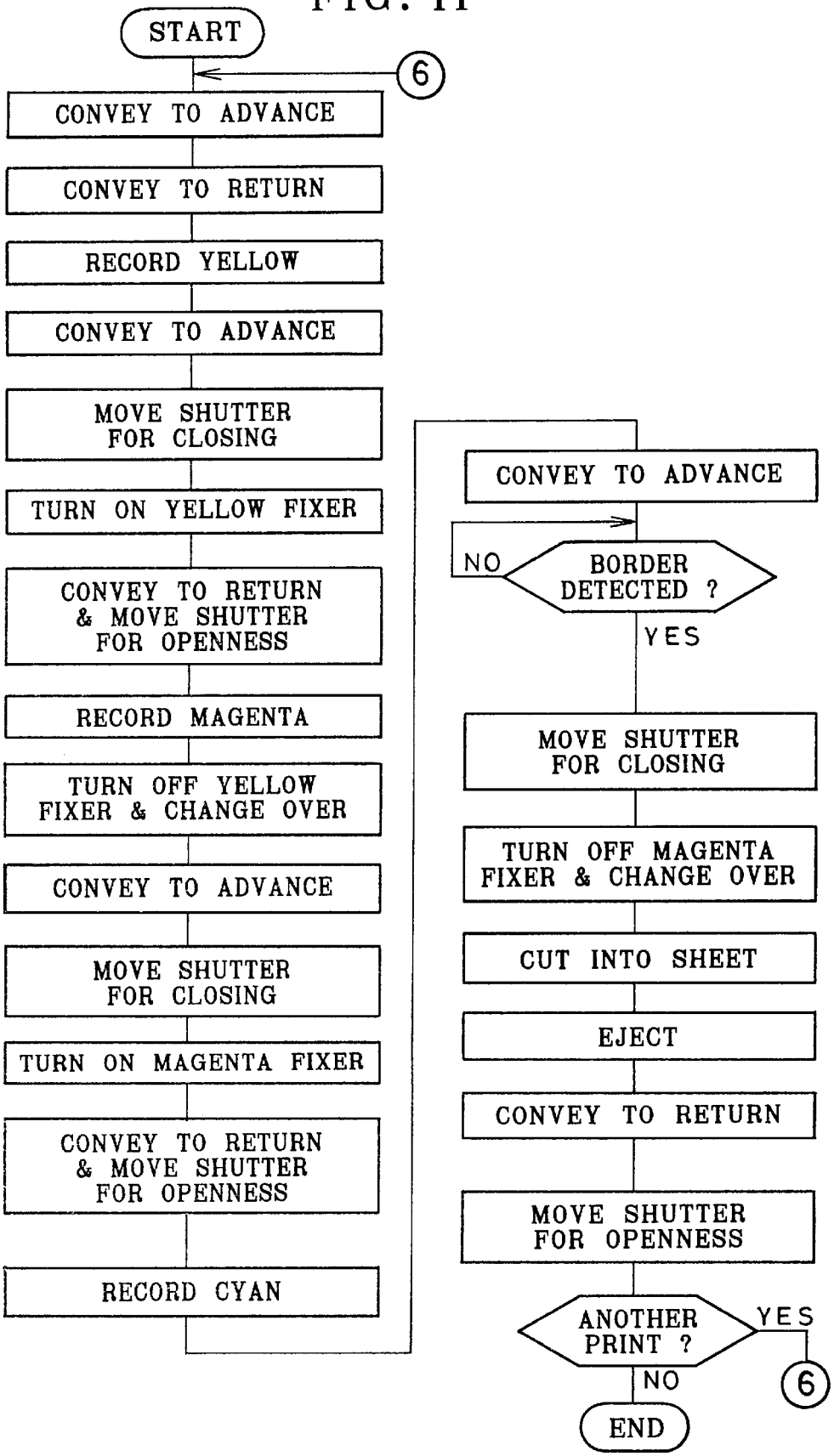
FIG. 11 is a flow chart illustrating another printing process in which the recording material is fixed only in the returning conveyance.

In FIG. 10, the recording material 12 is fixed both in the advancing and returning directions. Alternatively the recording material 12 may be fixed only in the returning conveyance as illustrated in FIG. 11. In this embodiment, a first return of the recording material 12 after a first advancement is used for recording the yellow image. A second return of the recording material 12 after a second advancement is used for fixing the yellow image and recording the magenta image. A third return of the recording material 12 after a third advancement is used for fixing the magenta image, recording the cyan image, and bleaching the recording material 12. A fourth advancement is used for bleaching the recording material 12. Also it is possible that a third return of the recording material 12 is used for recording the cyan image without bleaching, and that a fourth advancement of the recording material 12 is used for bleaching of the recording material 12. The shutter 40 shields the non-recording area NPA from ultraviolet rays while the non-recording area NPA passes the ray applying region A1 as illustrated in FIG. 5.

In the above embodiments, the time points of opening and closing the shutter 40 are determined by counting pulses for the stepping motor 42. Alternatively it is possible to use a sensor for detecting the front edge of the recording material 12. Time points of opening and closing the shutter 40 can be determined upon an output of the sensor. Also a timer may be used for measuring time elapsed after a start of a printing operation. Time points of opening and closing the shutter 40 can be determined according to lapse of predetermined time measured by the timer.

Also a stationary platen plate may be used instead of the platen roller 30. The supply roller set 11, the conveyor roller set 15 and the exit roller set 52 may constantly have the nipping state. The supply roller set 11 and the exit roller set 52 may be driven at the same direction as the conveyor roller set 15 and at the same conveying speed as the conveyor roller set 15. The positions of the cutter 50 and the fixer assembly 35 may be changed as required. The shutter 40, as opaque plate according to the above embodiments, may be an opaque screen, curtain or cloth or any other opaque flat member. The shutter 40 is slidable in a straight direction, but may be shaped in an arcuate form, and moved along a circular path in which the arcuate form is included. Namely the shutter 40 may be rotatable about an axis, to enter the ray applying region A1.

Figure 12:
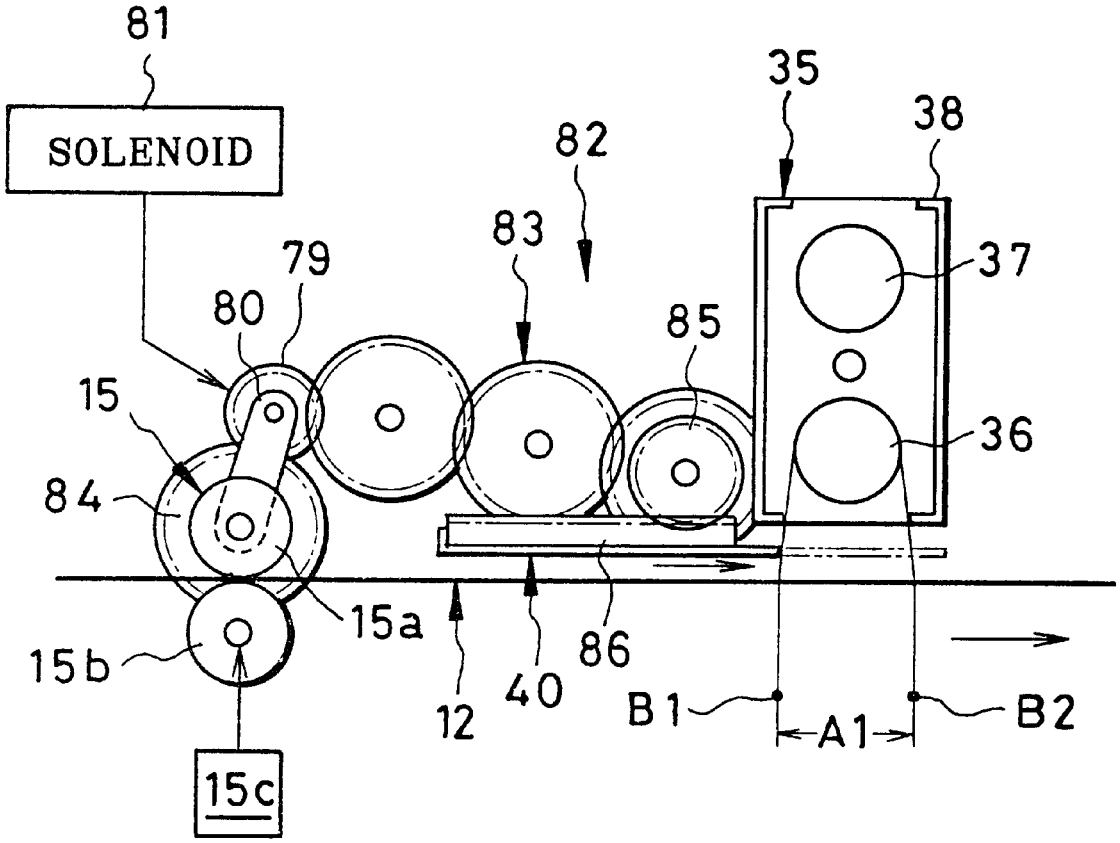
FIG. 12 is an explanatory view illustrating another preferred shutter drive unit including a planet gear.

In the above embodiments, rotation of the stepping motor 42 is transmitted by the electromagnetic clutch 44 to the pinion 45 in FIG. 2. Alternatively a construction of FIG. 12 may be used for transmission. A planet gear 79 as shutter drive unit is rotatable on an arm 80. The planet gear 79 is brought by a solenoid 81 into mesh with a transmission gear train 83 of a shutter drive unit 82. A drive gear 84 as sun gear is rotatable together with the capstan roller 15*a*. Rotation of the drive gear 84 is transmitted by the transmission gear train 83 to a pinion 85, which in turn moves a rack 86 back and forth to open and close the shutter 40. The shutter drive unit 82 has a gear ratio and a rotational direction determined in such a manner that the shutter 40 has the same moving direction and the same speed as those of the recording material 12. It is to be noted that one other motor may be used for moving the shutter 40, and may be controlled in such a manner that the shutter 40 has the same moving direction and the same speed as those of the recording material 12.

The lamp housing 38 of the fixer assembly 35 is caused to make half a rotation for changeover of setting at the fixing position. Alternatively a yellow fixing lamp and a magenta fixing lamp may be arranged straight in the conveying direction of the recording material 12. Of course a plurality of yellow fixing lamps or magenta fixing lamps may be used. Furthermore, the lamp housing 38 may be additionally provided with a vertical shifter. To change over the lamp housing 38, the lamp housing 38 is lifted by the vertical shifter away from the printing path at first. Then the lamp housing 38 is caused to make half a rotation, and then lowered by the vertical shifter to the printing path. This is advantageous in the use of a limited space inside the printer.

In the above embodiments, the shutter 40 has a correctly intermediate position between the recording material 12 and the fixer assembly 35. This intermediate position of the shutter 40 may be changed as required, in a range where the non-recording area NPA can be covered while passed in the ray applying region Al. The shutter 40 may be close to the fixer assembly 35. Or the shutter 40 may be close to the recording material 12. The latter is preferable in view of synchronism between movement of the shutter 40 and conveyance of the recording material 12. In the above embodiments, the shutter 40 is moved at the speed equal to that at which the recording material 12 is conveyed. However it is possible to dispose the shutter 40 in such a manner that a length L1 of the ray applying region A1 as viewed on the recording material 12 is significantly different from a length L2 of the ray applying region A1 as viewed on the shutter 40. With this disposition, it is possible to multiply the conveying speed of the recording material 12 by a ratio L2/L1 for determining the moving speed of the shutter 40.

The above-described control of the shutter 40 is used in a color thermal printer, but may be used in a monochromatic thermal printer. The above-described control of the shutter 40 is used in the thermal printer in the recording material 12 is horizontally conveyed by conveyor rollers, but may be used in a thermal printer incorporating a platen drum, which may be rotated to convey the recording material 12 along a rotational printing path.

In the above embodiment, the cutting line is predetermined for cutting of the recording material 12 by use of the cutter 50 to obtain a sheet as a print. Note that the cutting line may be determined to coincide with the border E1 which is between the recording area PA and the non-recording area NPA on the recording material 12. Of course the cutting line may be defined differently from the border E1, for example may be deviated from the border El in the advancing direction of the recording material 12.

In the above embodiment, the recording area PA has a blank marginal portion which extend along the four sides, outside a full-color image, and inside four edges of the sheet as print. A beginning edge of the image inside the recording area PA is located after a beginning edge of the recording area PA. A closing edge of the image inside the recording area PA is located before a closing edge of the recording area PA. The border E1 in the above description should be read as a virtual central line defined between the closing edge of the image inside the recording area PA and a beginning edge of a succeeding image inside the non-recording area NPA which becomes a succeeding recording area.

In the present invention, it is possible that eliminate the blank marginal portion lacks about the full-color image of the recording area PA, that an image of the recording area PA is directly adjacent to a next image for the non-recording area NPA as a succeeding image. Namely the border El is defined between the two images without any blankness or other sign.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal recording method for printing a full-color image on a color thermosensitive recording material, said recording material including a support and first, second and third thermosensitive coloring layers formed on said support in an order listed, said first to third coloring layers being different in colors to be developed and thermal sensitivity, said third coloring layer being farthest from said support and having fixability to electromagnetic rays of a first wavelength range, and said second coloring layer having fixability to electromagnetic rays of a second wavelength range, said color thermal recording method comprising steps of:

obtaining a definition of a recording area, a non-recording area adjacent to said recording area, and a border between said recording area and said non-recording area;

conveying said recording material along a printing path alternately in first and second directions, said second direction being opposite to said first direction, said recording material being conveyed in said first direction three times;

in conveying said recording material along said printing path in said first direction for said three times, recording first, second and third color images respectively to said first to third layers inside said recording area on said recording material by use of a thermal head;

applying said electromagnetic rays of said first and said second wavelength ranges to said recording material as said recording material is moved past a ray applying region in said printing path, to fix said second and third color images, respectively; and avoiding fixing of said second and said third coloring layers in said non-recording area by advancing a shutter in synchronism with said border, wherein said shutter blocks said electromagnetic rays from said non-recording area when said non-recording area is conveyed past said ray applying region.

2. The color thermal printing method as defined in claim 1, wherein said recording material is unwound from a roll, and cut into a sheet after said full-color image is recorded.

3. The color thermal printing method as defined in claim 2, wherein said first direction is toward said roll with respect to said recording material, and said fixer is disposed in said second direction with respect to said thermal head.

4. The color thermal printing method as defined in claim 3, further comprising steps of:

while said recording material is conveyed in said second direction, starting operating said fixer;

moving said shutter in said second direction at a speed of said recording material with a shutter edge of said shutter positioned at said border, until said ray applying region is fully closed;

after said ray applying region is fully closed, stopping operating said fixer;

after stopping operating said fixer, moving said shutter in said first direction, until said ray applying region is fully open.

5. The color thermal printing method as defined in claim 3, further comprising steps of:

when said ray applying region is fully closed, starting operating said fixer;

after said border is moved past said ray applying region in said second direction, conveying said recording material in said first direction;

moving said shutter in said first direction at a speed of said recording material with a shutter edge of said shutter positioned at said border, until said ray applying region is fully open;

after said ray applying region is fully open, stopping operating said fixer;

after stopping operating said fixer, moving said shutter in said second direction, until said ray applying region is fully closed.

6. The color thermal printing method as defined in claim 3, further comprising steps of:

while said recording material is conveyed in said second direction, starting operating said fixer;

moving said shutter in said second direction at a speed of said recording material with a shutter edge of said shutter positioned at said border, until said ray applying region is fully closed;

after said ray applying region is fully closed, conveying said recording material in said first direction;

moving said shutter in said first direction at a speed of said recording material with said shutter edge of said shutter positioned at said border, until said ray applying region is fully open;

after said ray applying region is fully open, stopping operating said fixer.

7. The color thermal printing method as defined in claim 2, wherein said first direction is away from said roll with respect to said recording material, and said fixer is disposed in said first direction with respect to said thermal head.

8. The color thermal printing method as defined in claim 7, further comprising steps of:

while said recording material is conveyed in said first direction, starting operating said fixer;

moving said shutter in said first direction at a speed of said recording material with a shutter edge of said shutter positioned at said border, until said ray applying region is fully closed;

after said ray applying region is fully closed, stopping operating said fixer;

after stopping operating said fixer, moving said shutter in said second direction, until said ray applying region is fully open.

9. The color thermal printing method as defined in claim 7, further comprising steps of:

when said ray applying region is fully closed, starting operating said fixer;

after said border is moved past said ray applying region in said first direction, conveying said recording material in said second direction;

moving said shutter in said second direction at a speed of said recording material with a shutter edge of said shutter positioned at said border, until said ray applying region is fully open;

after said ray applying region is fully open, stopping operating said fixer;

after stopping operating said fixer, moving said shutter in said first direction, until said ray applying region is fully closed.

10. The color thermal printing method as defined in claim 7, further comprising steps of:

while said recording material is conveyed in said first direction, starting operating said fixer;

moving said shutter in said first direction at a speed of said recording material with a shutter edge of said shutter positioned at said border, until said ray applying region is fully closed;

after said ray applying region is fully closed, conveying said recording material in said second direction;

moving said shutter in said second direction at a speed of said recording material with said shutter edge of said shutter positioned at said border, until said ray applying region is fully open;

after said ray applying region is fully open, stopping operating said fixer.

11. A color thermal printer for printing a full-color image on a color thermosensitive recording material, said recording material including a support and first, second and third thermosensitive coloring layers formed on said support in an order listed, said first to third coloring layers being different in colors to be developed and thermal sensitivity, said third coloring layer being farthest from said support and having fixability to electromagnetic rays of a first wavelength range, and said second coloring layer having fixability to electromagnetic rays of a second wavelength range, there being, for said recording material, a recording area, a non-recording area adjacent to said recording area, and a border between said recording area and said non-recording area, said color thermal printer comprising:

transport means for conveying said recording material along a printing path alternately in first and second directions, said second direction being opposite to said first direction;

a thermal head, disposed in said printing path, for recording first, second and third color images respectively to said first to third layers inside said recording area on said recording material, in conveying said recording material along said printing path in said first direction for three times;

a fixer, disposed in said printing path, for selectively applying said electromagnetic rays of said first and second wavelength ranges to said recording area within a ray applying region, to fix said second and said third color images;

a shutter, movable into and out of said ray applying region; and a shutter drive unit controlling said shutter to advance in synchronism with said border to block said electromagnetic rays from said non-recording area so as to avoid fixing said second and said third coloring layers in said non-recording area.

12. The color thermal printer as defined in claim 11, wherein said transport means is disposed in said first direction with respect to said thermal head, and includes:

a motor;

a capstan roller rotated by said motor; and a pinch roller for pushing said recording material to said capstan roller.

13. The color thermal printer as defined in claim 12, wherein said recording material is unwound from a roll, and cut into a sheet after said full-color image is recorded.

14. The color thermal printer as defined in claim 13, wherein said ray applying region has first and second ends arranged along said printing path, and said shutter has a shutter edge previously positioned at said first end of said ray applying region, and said shutter drive unit, while said shutter edge is positioned at said border, moves said shutter from said first end to said second end of said ray applying region, said ray applying region being changed from a fully open area to a fully closed area, or being changed from said fully closed area to said fully open area.

15. The color thermal printer as defined in claim 11, wherein said shutter drive unit includes a clutch, displaceable between connected and disconnected states, said clutch, when in said connected state, transmitting rotation of said motor to said shutter to move said shutter, and when in said disconnected state, rendering said shutter free from said motor.

16. The color thermal printer as defined in claim 15, further comprising:

a position detector for monitoring a position of said recording material along said printing path; and a controller for detecting a reach of said border to said first end of said ray applying region by evaluating a signal from said position detector, said controller displacing said clutch to said connected state in response to said reach of said border to said first end of said ray applying region.

17. The color thermal printer as defined in claim 15, wherein said shutter drive unit includes:

a transmission gear train for transmitting rotational force to said shutter;

a planetary gear mechanism, including a sun gear and a planet gear, said sun gear being connected to said capstan roller, and said planet gear being engageable with said transmission gear train; and a solenoid, constituting said clutch with said planetary gear mechanism, for displacing said planet gear, to mesh said planet gear with said transmission gear train, so as to displace said clutch to said connected state.

18. The color thermal printer as defined in claim 15, wherein said position detector includes an edge sensor and a counter, said edge sensor being disposed in said printing path, for detecting a front edge of said recording material, said counter counting pulses supplied for driving said stepping motor;

wherein in accordance with signals from said edge sensor and said counter, said controller detects that a counted number of said pulses comes up to a predetermined number while said recording material is moved along said printing path after said front edge is detected, to detect said reach of said border to said first end of said ray applying region.

19. The color thermal printer as defined in claim 15, wherein said first color image is yellow, said second color image is magenta, and said third color image is cyan.

20. The color thermal printer as defined in claim 19, wherein said fixer is disposed in said first direction with respect to said thermal head, and after said yellow image is recorded, fixes said yellow image while said recording material is conveyed in said first direction, and after said magenta image is recorded, fixes said magenta image while said recording material is conveyed in said first direction.

21. The color thermal printer as defined in claim 19, wherein said fixer is disposed in said first direction with respect to said thermal head, and after said yellow image is recorded, fixes said yellow image while said recording material is conveyed in said second direction, and after said magenta image is recorded, fixes said magenta image while said recording material is conveyed in said second direction.

22. The color thermal printer as defined in claim 19, wherein said fixer is disposed in said first direction with respect to said thermal head, and after said yellow image is recorded, fixes said yellow image while said recording material is conveyed in said first direction and then in said second direction, and after said magenta image is recorded, fixes said magenta image while said recording material is conveyed in said first direction and then in said second direction.

23. The color thermal printer as defined in claim 19, wherein said fixer is disposed in said second direction with respect to said thermal head, and after said yellow image is recorded, fixes said yellow image while said recording material is conveyed in said second direction, and after said magenta image is recorded, fixes said magenta image while said recording material is conveyed in said second direction.

24. The color thermal printer as defined in claim 19, wherein said fixer is disposed in said second direction with respect to said thermal head, and after said yellow image is recorded, fixes said yellow image while said recording material is conveyed in said first direction, and after said magenta image is recorded, fixes said magenta image while said recording material is conveyed in said first direction.

25. The color thermal printer as defined in claim 19, wherein said fixer is disposed in said second direction with respect to said thermal head, and after said yellow image is recorded, fixes said yellow image while said recording material is conveyed in said second direction and then in said first direction, and after said magenta image is recorded, fixes said magenta image while said recording material is conveyed in said second direction and then in said first direction.

* * * * *